United States Patent [19]

Keith

[11] Patent Number: 4,655,736

[45] Date of Patent: Apr. 7, 1987

[54] METHOD OF MANUFACTURING A TOBACCO SMOKE FILTER

[75] Inventor: Charles H. Keith, Charlotte, N.C.

[73] Assignee: Brown & Williamson Tobacco Corporation, Louisville, Ky.

[21] Appl. No.: 670,110

[22] Filed: Nov. 9, 1984

[51] Int. Cl.[4] ..... A24D 3/02

[52] U.S. Cl. ..... 493/43; 493/42; 131/339; 131/340; 131/336

[58] Field of Search ..... 131/336, 339, 92, 94

[56] References Cited

U.S. PATENT DOCUMENTS

| | | | |
|---|---|---|---|
| 3,958,498 | 5/1976 | Payne | 493/43 |
| 4,256,122 | 3/1981 | Johnson | 131/339 |
| 4,331,166 | 5/1982 | Hale | 131/339 |
| 4,457,319 | 7/1984 | Lamb et al. | 131/339 |

*Primary Examiner*—Vincent Millin

*Attorney, Agent, or Firm*—Charles G. Lamb

[57] ABSTRACT

A method of manufacturing tobacco smoke filter of filamentous material with at least one end thereof having a preselected fused area embedded in and over at least a portion of the cross-sectional area thereof having a preselected fused area extending over at least a portion of the cross-sectional area thereof to provide a flow directing baffle to direct smoke through the unfused end portion. The method includes forming a longitudinally extending porous rod of fusible material, cutting the rod into filter unit lengths and conveying the filter units in a longitudinal path normal to the longitudinal axis of the filter units past a fusing station located to one side of the conveying path. The fusing station forms an indented and fused area in one end of each filter unit as the filter units are conveyed there past. The fusing station can be a rotating wheel with conical teeth corresponding to the configuration of the indented area which teeth are embedded into the filter units. As the filter units are conveyed past the wheel the wheel rotates embedding a tooth into a filter unit.

5 Claims, 4 Drawing Figures

METHOD OF MANUFACTURING A TOBACCO SMOKE FILTER

BACKGROUND OF THE INVENTION

1. Field of the Invention

The present invention relates to tobacco smoke filters and, more particularly, to an improved tobacco smoke filter of a type having a deflecting baffle therein to control tobacco flow.

2. Description of the Prior Art

It has long been known in the smoking art to provide tobacco smoke filters at one end of smoking articles, the filters being provided with means to alter the tobacco stream flow to improve efficiency. Recently issued U.S. Pat. No. 4,457,319, issued to Charles G. Lamb et al, on July 3, 1984, teaches such an arrangement for a filter by inserting a conically shaped element at the outlet end of the filter to diverge the smoke in a generally angularly outward direction at the mouth end of the filter.

The present invention, recognizing the importance of controlling the flow of tobacco smoke in a filter to maximize taste and efficient smoke delivery to the mouth of a smoker, provides an efficient, straightforward and economical filter arrangement and a method of making the same which requires a minimum of parts in construction and a minimum of steps in manufacture, the present invention lending itself to ready adaption to various filter ventilating arrangements.

Various other features of the present invention will become obvious to one skilled in the art upon reading the disclosure set forth herein.

SUMMARY OF THE INVENTION

More particularly, the present invention provides an improved tobacco smoke filter comprising: a porous filter of fusible filamentous material having opposed inlet and outlet ends; at least one of the ends having at least one preselected fused area extending over at least a portion of the entirety of the cross-sectional area of the end to provide a flow directing baffle to direct smoke flow through the remaining unfused portion of the end.

In addition, the present invention provides a novel method to manufacture tobacco smoke filter units including forming a longitudinally extending porous rod from structurally stable, fusible material; cutting the rod to filter unit lengths with opposed inlet and outlet ends; and fusing at least one of the ends of each filter unit in a preselected configuration over at least a portion of the entirety thereof to provide a flow directing baffle to direct smoke flow through the remaining unfused portion of the end.

It is to be understood that various changes can be made by one skilled in the art in the arrangement, form, shape and construction of the inventive product disclosed and in the several steps of the inventive method disclosed without departing from the scope or spirit of the present invention.

BRIEF DESCRIPTION OF THE DRAWING

Referring to the drawing which discloses an advantageous embodiment of the inventive product and inventive method of making the same.

DESCRIPTION OF THE PREFERRED EMBODIMENT

Figure 1:
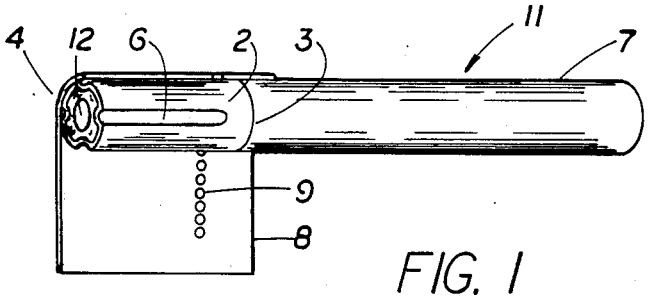
FIG. 1 is a perspective view of one advantageous embodiment of the inventive tobacco smoke filter of the present invention attached to a smoking article in the form of a cigarette with the tipping material shown in unwrapped condition.
Figure 2:
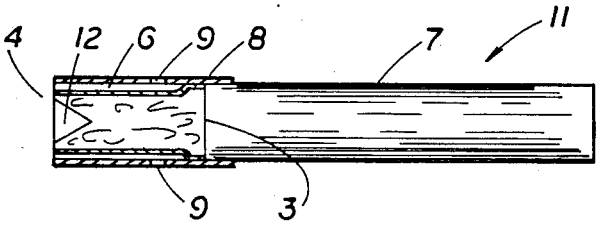
FIG. 2 is a side view of the cigarette of FIG. 1 showing the filter in section.

Referring to FIGS. 1 and 2 of the drawings, a filter 2 is disclosed. Filter 2 is formed from a generally cylindrical porous filter rod of heat fusible, fibrous, filamentous material with the fibers extending in a generally longitudinal direction along the axis of the filter rod, the rod being successively cut to form a plurality of such unit filters 2. Advantageously, the fiber rod material can be formed from any one of a number of known cellulose acetate materials or of any other fibrous or foam materials suitable for tobacco smoke so long as such material is readily heat or chemically fusible.

Filter 2 includes opposed tobacco smoke inlet end 3 and mouth end 4 and, as disclosed, longitudinally extending ventilating grooves 6 are spaced about the outer peripheral wall of filter 2. Circumscribing filter 2 to join the filter at end 3 to tobacco rod 7 to form smoking article or cigarette 11, is a suitable wrapping or tipping material 8 which is provided with a row 9 of spaced apertures communicating with ventilating grooves 6. It is to be understood that the present invention is not to be considered as limited to the particular ventilating grooves and tipping material assembly disclosed but that other types of porous or non-porous wraps and filter wall configurations can be used, it only being essential that the filter be of a suitable fusible material which, when selectively fused, either by heating or by appropriate non-toxic chemical treatment, serves to provide a substantially smoke impervious fused baffle 12.

Fused baffle 12 in the embodiment of cigarette 11 disclosed is of a geometrically conical contour similar to the embedded baffle or U.S. Pat. No. 4,457,319 and is located at the central area of the mouth end or outlet end of filter 2 to make the central area substantially impervious to smoke. As in U.S. Pat. No. 4,457,319, when a smoker draws on the mouth end of filter 2 while smoking, ventilating air is drawn through apertures 9 in tipping material 8 into grooves 6 to travel to the mouth end 4 of filter 2. At the same time, smoke is drawn through filter 2. Baffle 12 creates a flow restriction at mouth end 4 diverting the smoke generally angularly outward toward the annular flow through space at the mouth end into the path of the ventilating air traveling along grooves 6, creating eddy currents and dispersing smoke in the smoker's mouth to increase perceived taste. It is to be understood that the geometry of the fused area, the degree of smoke imperviousness, and the configuration of ventilating structure employed can be varied in accordance with the ventilating air-smoke results desired without departing from the scope or spirit of the present invention. For example, the fused or baffle portion can extend substantially over the entirety of the cross-section of the filter with selected portions of the baffle being porous.

Figure 3:
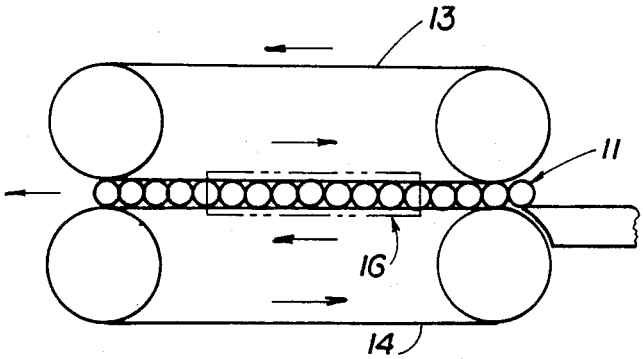
FIG. 3 is a schematic side view of apparatus used in carrying out the inventive method to manufacture the smoke filter of FIGS. 1 and 2, including an endless belt and embossing wheel arrangement.
Figure 4:
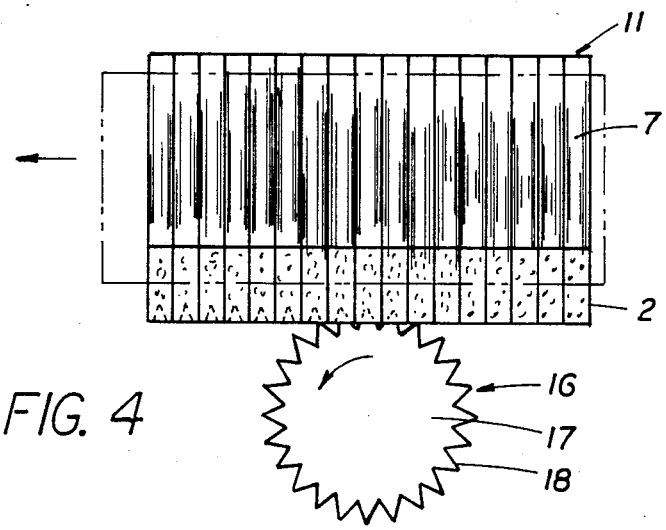
FIG. 4 is a schematic top view of the apparatus of FIG. 3.

Referring to FIGS. 3 and 4 of the drawing, a novel manufacturing method of fusing tobacco smoke filters such as aforedescribed is disclosed. As is known in the art and as described above, a filter can be formed in any one of several possible manners (not disclosed) from a generally cylindrical porous filter rod of heat fusible, fibrous filamentous material with the fibers extending in a generally longitudinal direction along the axis of the filter rod, the rod then being successively cut to form a plurality of filter units, each of which in turn is assembled to a tobacco rod to form a smoking article such as cigarette 11. As aforenoted, the filter rod material selected can vary so long as such material is readily fusible.

The smoking articles 11 are conveyed between two endless counter-rotating belts 13 and 14, the belts being moved at different speeds and so spaced that the lower flight of the upper belt 13 and the upper flight of belt 14 engage the peripheral sides of the cigarettes 12 to nip and move the cigarettes in a longitudinal path normal to the longitudinal axes about which the cigarettes are also caused to rotate as they are nipped by the spaced differentially speeding belts.

As the cigarettes 11 are so moved and rotated, the fusible filter ends 2 thereof pass a fusing station 16 positioned adjacent the passing filter ends between the extremities of the spaced belts which, in turn, can be mounted between the inversion mechanism and the catcher on a cigarette machine (not shown).

Fusing station 16, as schematically disclosed, is in the form of a heated rotating embossing wheel 17, with the teeth 18 thereof so shaped to form a conically fused and indented smoke impervious area in the filter unit 2 of each cigarette, the fused and indented area being so spaced from the peripheral wall of each unit filter 2 to provide an annular flow through passage therearound.

As aforenoted, the geometry of the teeth 18 of wheel 17 and thus the geometry of the fused area 12 and the degree of smoke imperviousness can be varied in accordance with the results sought to be obtained.

The invention claimed is:

1. A method of manufacturing a tobacco smoke filter comprising:

forming a longitudinally extending porous rod from structually stable, fusible material; cutting said rod to filter unit lengths having opposed inlet and outlet ends; conveying said filter units through endless belts moving at different speeds and spaced to engage the peripheral side of said filter units in a longitudinal path normal to the longitudinal axis of said units past a fusing station adjacent one side of said longitudinal conveying path; and fusing at least one of said ends of each of said filter units in a preselected configuration over at least a portion of the entirety of the cross-sectional area thereof to provide a flow directing baffle to direct smoke flow through the remaining unfused portion of said end as they pass said fusing station.

2. The method of claim 1, including heating and indenting said portion of one of said ends of each of said filter units to fuse and shape said portion.

3. The method of claim 2, including heating and indenting simultaneously.

4. The method of claim 3, including heating and indenting simultaneously in a conically shaped fashion along the longitudinal axis of said end to form a conically fused area spaced from the periphery providing an annular flow-through passage therearound.

5. A method of manufacturing a tobacco smoke filter comprising: forming a generally cylindrical porous filter rod of heat fusible, fibrous, filamentous material with fibers extending in a generally longitudinal direction along the longitudinal axis of said rod; cutting said rod to filter unit lengths having opposed inlet and outlet ends; assembling each of said filter units to a wrapped cylindrical tobacco rod to form a plurality of smoking articles; conveying said smoking articles through endless belts moving at different speeds and spaced to engage the peripheral sides of said smoking articles to move said smoking articles in a longitudinal path normal to the longitudinal axes of said smoking articles and to rotate said smoking articles about their longitudinal axes; and indenting and heating the filter ends of said smoking articles at a fusing station positioned adjacent the filter ends of said smoking articles, with the conical teeth of a heated rotating embossing wheel to form a conically fused and indented substantially smoke impervious area in each filter end spaced from the periphery of such end to provide an annular flow-through passage therearound in each smoking article filter.

* * * * *